United States Patent [19]

Davis

[11] Patent Number: 4,702,399

[45] Date of Patent: Oct. 27, 1987

[54] DISPENSER

[75] Inventor: John W. Davis, Dorset, United Kingdom

[73] Assignee: Metal Box p.l.c., Reading, England

[21] Appl. No.: 788,143

[22] Filed: Oct. 16, 1985

[30] Foreign Application Priority Data

Apr. 1, 1985 [GB] United Kingdom ..... 8508430

[51] Int. Cl.[4] ..... A45D 40/04

[52] U.S. Cl. ..... 222/390; 401/75; 401/175

[58] Field of Search ..... 222/386, 390; 401/68, 401/75, 175; 403/359

[56] References Cited

U.S. PATENT DOCUMENTS

| | | | |
|---|---|---|---|
| 1,861,640 | 6/1932 | McCabe | 403/359 X |
| 1,904,612 | 4/1933 | Brauson | 401/175 |
| 2,838,270 | 6/1958 | Danielson | 403/359 X |
| 3,608,685 | 9/1971 | Childress | 403/359 X |
| 3,907,441 | 9/1975 | Idec et al. | 401/75 |
| 3,917,417 | 11/1975 | Lang | 401/75 |
| 4,210,372 | 7/1980 | McGee et al. | 403/359 X |
| 4,298,036 | 11/1981 | Horvath | 222/390 X |
| 4,369,158 | 1/1983 | Woodruff et al. | 401/68 X |
| 4,411,549 | 10/1983 | Sheppard | 403/359 X |
| 4,521,127 | 6/1985 | Tomburo et al. | 401/68 |
| 4,552,161 | 11/1985 | Hill et al. | 401/75 X |

FOREIGN PATENT DOCUMENTS

| | | | |
|---|---|---|---|
| 2139123 | 4/1979 | Fed. Rep. of Germany | 222/386 |
| 2807472 | 8/1979 | Fed. Rep. of Germany | 401/75 |
| 1529772 | 6/1968 | France | 401/68 |
| 2556941 | 6/1985 | France | 401/75 |

*Primary Examiner*—Robert J. Spar
*Assistant Examiner*—P. McCoy Smith
*Attorney, Agent, or Firm*—Diller, Ramik & Wight

[57] ABSTRACT

A dispenser for semi-solid material such as deodorant comprises a tubular barrel, a radial flange of which holds captive a knurled drive wheel for rotation abotu the axis of the barrel. An elevator is mounted on a spindle connected to the drive wheel and is adapted to move deodorant up and down the barrel on rotation of the wheel. To facilitate bottom-filling of the dispenser the elevator is formed from a radially inner part and a radially outer part. The radially outer part is positioned in the barrel before filling, and the radially inner part, preassembled on the spindle, is then clipped into the radially outer part while the deodorant is still in liquid form.

18 Claims, 7 Drawing Figures

DISPENSER

BACKGROUND OF THE INVENTION

1. Field of the Invention

The invention relates generally to dispensers and in particular to dispensers for semi-solid material in stick form which have a tubular barrel for housing the material and are provided with a drive mechanism for moving the material axially to and fro along the barrel for dispensing material at an open end of the barrel.

2. Description of the Prior Art

In a known dispenser of this type the drive mechanism comprises an actuator adapted to be rotated by hand, and an elevator which is driven axially of the barrel to move material therealong. The actuator comprises a knurled drive wheel held captive for rotation by an inwardly directed radial flange at one end of the barrel, and a threaded spindle extending axially inside the barrel. The elevator comprises a unitary moulding screwed onto the spindle such that rotation of the drive wheel causes the elevator to move axially along the barrel.

Dispensers of this type are particularly suited for dispensing deodorant and other semi-solid materials in stick form. The stick is formed in situ from a liquid, usually (but not necessarily) molten, which is introduced into the barrel and allowed to solidify. The stick must be sufficiently well attached to the elevator for the elevator to be able to push the stick along the barrel for use and to withdraw it $ub$equently against the frictional resistance presented by the interior of the barrel. A known method of manufacture is to assemble the dispenser by inserting the elevator into the barrel through the dispensing end thereof and to introduce the actuator through the opposite end of the barrel so that the elevator is engaged on the spindle and the drive wheel is located by the radial flange. The barrel is then top-filled with hot liquid through the dispensing end thereof. However, the assembly of the elevator with the actuator is a slow and expensive part of the process, and a stick filled in this way tends to shrink on cooling, with the result that its free surface adopts a concave profile. This is undesirable for aesthetic and practical reasons. It is thus desirable to fill the barrel when inverted, through the end in which the actuator is located when assembled. Bottom-fill of the dispenser through the central orifice provided in the elevator when the actuator is disassembled therefrom cannot be undertaken with the conventional design of dispenser, since this orifice is of insufficient dimension to allow uninterrupted flow of the product, which may be a suspension with a high solids content and liable to set on any obstruction which is presented.

One solution to this problem which has been adopted in the prior art is to omit the inwardly directed radial flange which holds the actuator captive, and to replace it with a suitable formation over which the drive wheel of the actuator is clipped and which thereafter holds the actuator captive for rotation. In this case the elevator and actuator can be preassembled together and clipped on to the barrel after filling when the product is still in a liquid phase. This of course is not possible when an inwardly directed radial flange is provided, since the elevator must then be inserted into the barrel through the dispensing end of the barrel.

In the absence of the radial flange the barrel presents a full diameter filling aperture, so that from the point of view of both filling speed and assembly, a modification of this kind has proved satisfactory for dispensers of essentially circular cross-section. However, the current move is strongly towards non-circular e.g. oval barrels, and for these dispensers the modification is not appropriate, requiring as it does a barrel cross-section which is circular to enable the drive wheel to rotate on it.

SUMMARY OF THE INVENTION

There are thus four conflicting requirements which should desirably be satisfied. The first is the requirement for preasseably of the elevator on the actuator to allow for fast production; the second is the requirement for a large diameter filling aperture; the third is the requirement that the dispenser be bottom-filled., and the fourth is that the dispenser design should have a capability for use with non-circular barrels. According to the invention there is provided a dispenser for semi-solid material in stick form having a tubular barrel for housing the material and a drive mechanism for moving material axially of the barrel for dispensing at an open end thereof, the drive mechanism comprising an actuator adapted to be rotated by hand and an elevator which is driven axially of the barrel to move material therealong on rotation of the actuator; wherein the elevator comprises a radially outer part adapted to engage and hold the material for moving the same along the barrel in either direction, and a radially inner part separate from the outer part and adapted to be drivingly engaged by the actuator, the inner and outer parts of the elevator being held against relative movement after assembly thereof.

Assembly of a dispenser according to the invention can be carried out by the steps of:

(a) locating the outer part of the elevator in the barrel;
(b) filling the barrel with material in liquid form through a central orifice in the outer part of the elevator;
(c) assembling the inner part of the elevator on the actuator and
(d) moving the assembly formed during step (c) axially into the barrel to cause the inner and outer parts of the elevator to engage one another and prevent further relative movement.

The invention may be applied equally to dispensers having circular or non-circular (e.g. oval) barrels. As will be understood, the actuator and the inner part of the elevator may be identical for those with circular or non-circular barrels. The radially outer part of the elevator will have a cross-sectional shape which conforms to the internal profile of the barrel. In an embodiment of the invention, a secondary cover is fitted over the dispensing end of the barrel to form a mould for that end of a deodorant stick; the secondary cover is shaped so as to leave the deodorant stick with a profiled protruding end when first opened by the consumer. An outer cap is also provided, arranged to cover the secondary cover. The outer cap and secondary cover are attached to the barrel before step (b) of the previous paragraph is performed.

DETAILED DESCRIPTION OF THE INVENTION

Figure 1:
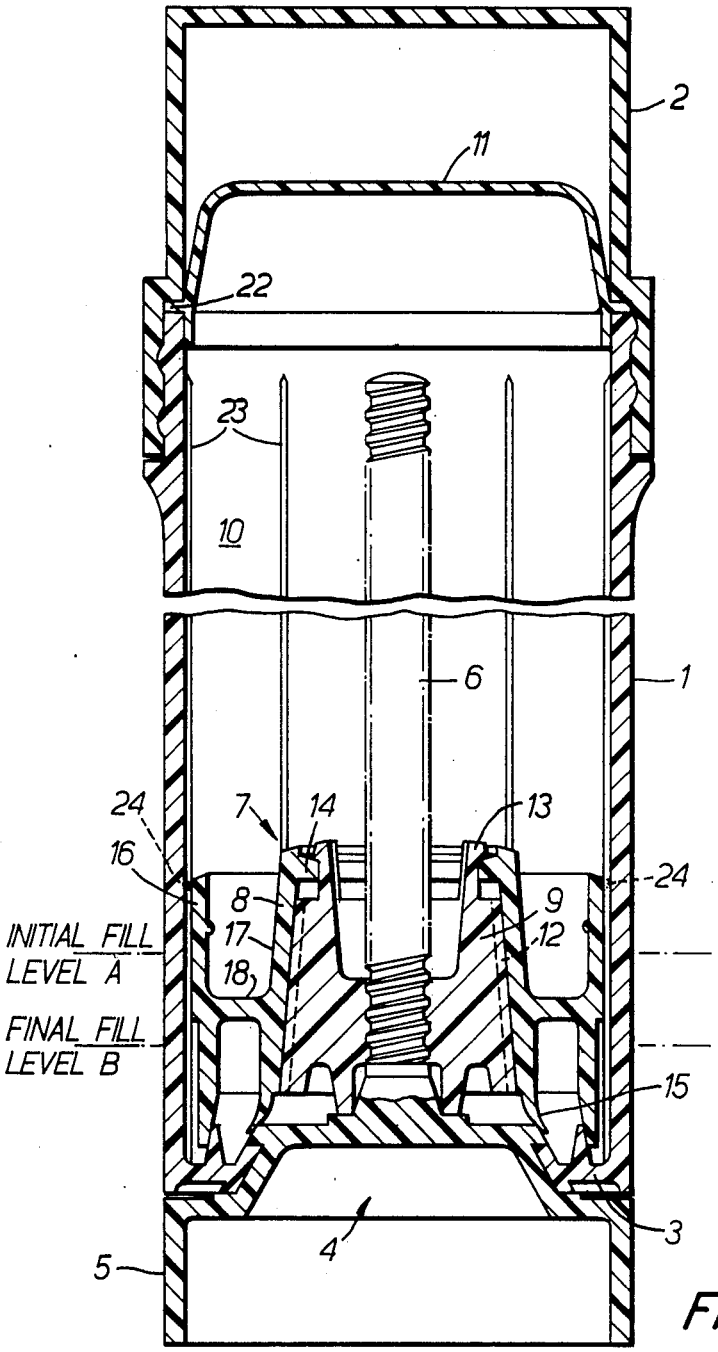
FIG. 1 shows a longitudinal section through a first dispenser which is generally of circular cross-section.

Referring to FIG. 1 the dispenser comprises a tubular barrel 1 which is closed at the dispensing end by a removable screw cap 2. The other end of the barrel is partly closed by an integral radial flange 3 by which an actuator 4 is held captive for rotation. To this end, the actuator is provided with an outwardly extending radial flange which can be snap fitted over the radial flange 3. The actuator comprises a knurled drive wheel 5 connected to an axially extending screw threaded spindle 6; the wheel 5 being accessible for manual operation by a user.

An elevator 7 which carries a stick of deodorant material for forward and backward movement along the barrel as the actuator is rotated one way or the other comprises a radially outer part 8 and a radially inner part 9, and is threaded on to the spindle 6 by means of a central threaded bore in its inner part 9. The outer part 8 of the elevator is fitted into the barrel and moves axially of the barrel with the inner part 9 as the wheel 5 is rotated.

Longitudinally extending and circumferentially spaced splines 23 are moulded to project from the inside wall of the barrel 1. In conventional manner they are dimensioned and profiled so as to deeply indent a sealing flange 24 which is formed around the periphery of the elevator 7 adjacent the product. They thereby prevent the elevator rotating when the actuator 4 is operated.

A secondary cover 11 is provided at the dispensing end of the dispenser. This secondary cover is shaped to provide the desired end form to the deodorant stick 10 and, like the screw cap 2, is removed by the consumer when dispensing is required. The secondary cover 11 may then be discarded, but the screw cap 2 is retained for reclosure. As shown, the secondary cover 11 has a peripheral flange 22 which is pressed by the screw cap 2 against the free end surface of the barrel 1 so as to form an airtight seal for the deodorant stick 10 to the point of first use.

The inner and outer parts 8,9, respectively of the elevator 7 are restrained from relative rotation by interlocking splines 12. In addition, a plurality of resilient fingers 13 integral with the inner part 9 engage on an inwardly directed annular flange 14 formed on the outer part 8 and are effective to hold the two parts together axially. In the fully retracted position, the outer part 8 of the elevator engages the actuator 4 by means of a sealing skirt 15.

Figure 2:
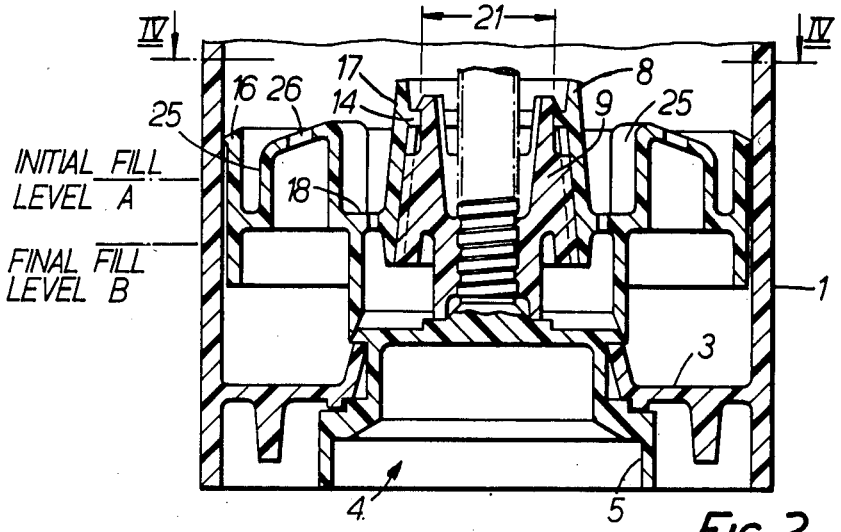
FIG. 2 shows a section through the lower part of a second dispenser, which is generally of oval cross-section.
Figure 3:
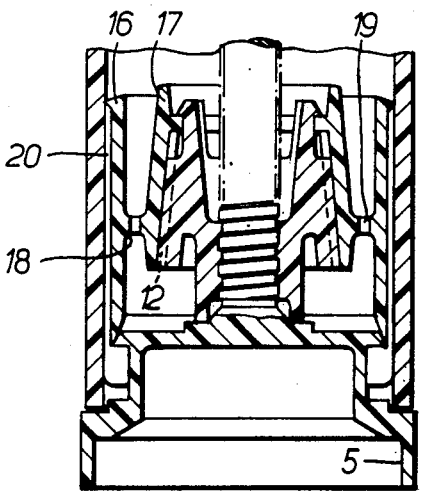
FIG. 3 shows a section through the dispenser of FIG. 2 at right angles to the section of FIG. 2.

FIGS. 2 and 3 show an alternative embodiment of the dispenser wherein the barrel 1 is of an oval rather than circular cross-section. The actuator 4 and the inner part 9 of the elevator 7 are however of identical construction to that of FIG. 1. The outer part 8 of the elevator will naturally have an oval configuration in this case to conform to the internal dimensions of the barrel 1. The non-circularity of the elevator part 8 and the barrel 1 will prevent rotation of the elevator when the actuator 4 is operated; no formations such as the splines 23 of FIG. 1 are therefore provided.

In both the embodiments described, the inner part 9 of the elevator is of a substantially frusto-conical configuration and is received within the outer part 8 and engages therewith over a frusto-conical surface. The outer part 8 comprises an outer wall 16 connected to an inner wall 17 by means of a web 18. As shown in FIGS. 2 and 3, vent holes 19 may be provided in the web 18 to provide for the escape of air during bottom-filling and to provide hydraulic cushioning when the inner part 9 of the elevator and the spindle 6 of the actuator 4 are immersed in the liquid deodorant material as is later to be described.

Referring to FIG. 3, circumferentially spaced and longitudinally extending rub strips 20 are formed to project from the surface of the elevator. These rub strips 20 prevent any substantial yawing movements of the elevator 7 as it moves along the barrel 1. Similar strips (not shown) are provided on the elevator 7 of the embodiment of FIG. 1, for the same purpose. They are located between the anti-rotation splines 23 circumferentially of the dispenser.

Figure 4:
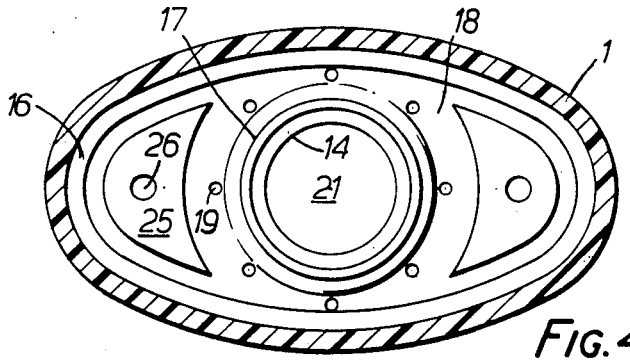
FIG. 4 shows a cross-sectional view of the dispenser of FIG. 2 taken along line IV—IV with parts removed for filling of the dispenser.

As shown in FIGS. 2 and 4 the web 18 may be provided with upstanding hollow posts 25 which assist in keying the stick of material to the elevator. These posts are provided with apertures 26 to allow the material to flow into them during filling.

Referring to FIG. 4, the filling orifice 21 which the part 8 provides is clearly shown, being defined by the inner surface of the annular flange 14.

Filling and assembly of the dispenser is as follows:

The outer part 8 of the elevator is first inserted into the barrel 1 through the dispensing end thereof and moved along the barrel to a position adjacent the opposite end. The secondary cover 11 and screw cap 2 are then fitted onto the barrel. With the barrel inverted, molten deodorant is poured into the barrel by means of a nozzle (not shown) which is inserted through the orifice 21 to adjacent the cover 11, and which is thereafter progressively retracted as filling proceeds. When the deodorant level has reached the initial fill level A, the deodorant flow is stopped and the nozzle is withdrawn. While the deodorant is still liquid, the previously formed assembly comprising the actuator spindle 6 and the inner part 9 of the elevator 7 screwed thereon, is pushed axially into the barrel (without rotation) until the fingers 13 engage over the flange 14 to lock the parts 8,9 of the elevator immovably together. Because of the displacement caused by the insertion of the items 6 and 9, the level of deodorant will then reach the final fill level B. At substantially the same time as the inner part of the elevator is clipped into position, the actuator 4 becomes snapped onto the radial flange 3 and is held captive therewith. The inversion of the barrel 1 is maintained until the deodorant has cooled and solidified to form the deodorant stick 10, the secondary cover acting as a mould to form the stick with a profiled end of desired shape; moreover, in FIG. 1 the anti-rotation splines 23 mould their own individual grooves in the stick so as to reinforce their action on the elevator to subsequently prevent rotation of the stick when the actuator 4 is operated. During product filling, the flange 24 prevents escape of the deodorant along the interface between the elevator 7 and the barrel 1.

Figure 5:
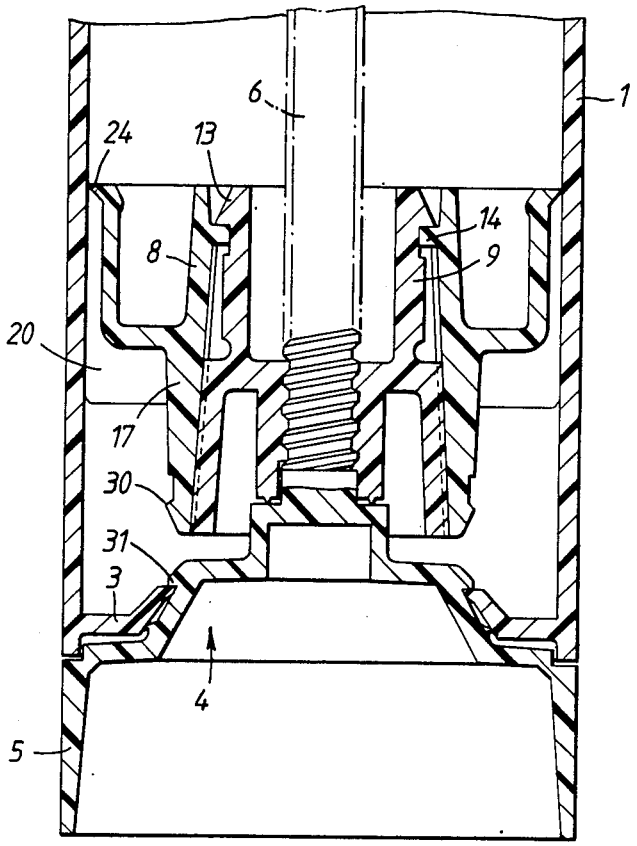
FIG. 5 shows a cross-sectional view of a dispenser incorporating a modification.

The embodiment shown in FIG. 5 provides a modification which enables the outer part 8 of the elevator to be held in position whilst the dispenser is filled and whilst the inner part 9 of the elevator is pushed into locking engagement therewith. The bottom of the inner wall 17 of the part 8 is profiled to form a latch 30 by means of which the part 8 can be snapped into holding engagement with the radial flange 3 prior to filling of the dispenser. After the dispenser has been filled the actuator 4, with the inner part 9 of the elevator 7 assembled thereon, is inserted through the outer part 8 until the fingers 13 engage over the flange 14, and during this operation the outer part 8 is held in position by the engagement of the latch 30 with the flange 3. After the inner and outer parts of the elevator have become locked together the actuator is pushed further into the dispenser causing the latch 30 to disengage from the flange 3 and the outwardly extending flange 31 to be snap-fitted over the flange 3. For this sequence of events to occur satisfactorily it is of course necessary for the force required to engage the inner and outer parts of the elevator to be less than the force required to disengage the latch 30 from the flange 3. This modification can be applied to any of the embodiments described.

Figure 6:
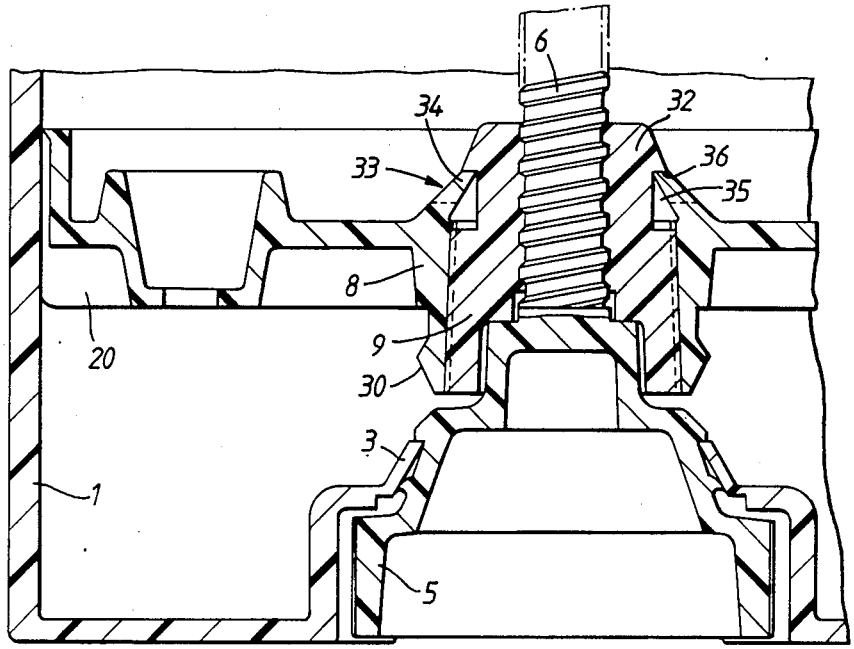
FIG. 6 shows a cross-sectional view of a dispenser incorporating another modification.
Figure 7:
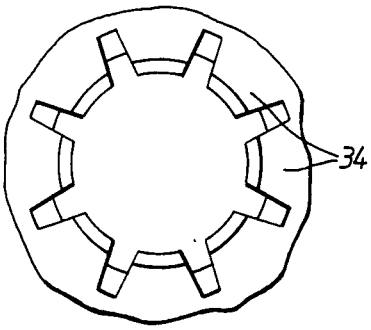
FIG. 7 shows a partial plan view of the outer part of the elevator of the dispenser of FIG. 6.

The embodiment shown in FIG. 6 shows a further modification which has particular application in a dispenser of smaller dimension in terms of the overall length of the barrel. In this modification the latching arrangement provided in other embodiments by the finger 13 and the annual flange 14 is replaced. A chamfered portion 32 of the inner part 9 of the elevator is pushed through an opening defined by a frusto-conical portion 33 of the outer part 8. The portion 33 is provided with a number of circumferentially spaced slots (not shown) which divided it into a plurality of resilient fingers 34 which enable it to expand resiliently as the chamfered portion 32 of the part 9 is pushed therethrough and subsequently to snap back into an annular recess 35 on the part 9 and into engagement with a shoulder 36. This modification can be applied equally to any of the embodiments described.

Filling and assembly of dispensers as modified in FIGS. 5 and 6 is the same as for the embodiments of FIGS. 1–4 except that, as already described, the outer part 8 of the elevator is engaged with the flange 3 prior to filling by means of the latch 30, and disengaged therefrom after the inner and outer parts of the elevator have been locked together.

The individual components 1,2,4,8,9, and 11 of the described embodiments are each injection-moulded from a suitable thermoplastics material; for example, items 1,2 and 4 may be of polypropylene, item 8 of high density polyethylene, item 9 of acetal, and item 11 of polystyrene. If desired, however, a dispenser in accordance with the invention may include one or more metal components.

I claim:

1. A dispenser for semi-solid material in stick form, having a tubular barrel for housing the material and a drive mechanism for moving material axially of the barrel for dispensing at an open end thereof, the drive mechanism comprising an actuator adapted to be rotated by hand and an elevator which is driven axially of the barrel to move material therealong on rotation of the actuator; wherein the elevator comprises a radially outer part adapted to engage and hold the material for moving the same along the barrel in either direction, and a radially inner part separate from the outer part and adapted to be drivingly engaged by the actuator; the inner part of the elevator is received within the outer part of the elevator and engages therewith over an interface extending around the axis of the barrel; first engaging means are provided at the interface for preventing relative rotation of the inner and outer parts of the elevator after assembly, and second engaging means for snap-securing said inner and outer parts together by relative axial movement of said inner and outer parts without relative rotary orientation.

2. A dispenser according to claim 1, wherein the actuator comprises a threaded spindle and a manually operated drive wheel which is held captive for rotation at one end of the tubular barrel by means of an inwardly directed radial flange on the barrel.

3. A dispenser according to claim 2 wherein the outer part of the elevator is provided with a latch for engagement with the radial flange on the barrel.

4. A dispenser according to claim 1, wherein the second engaging means comprises at least one resilient finger provided on one of the parts of the elevator engaging with a shoulder on the other part.

5. A dispenser according to claim 4, wherein the resilient fingers are provided on the inner part of the elevator and the shoulder or shoulders is provided by an annular flange on the outer part of the elevator.

6. A dispenser according to claim 4, wherein the resilient fingers are formed from a conical portion on the outer part of the elevator and the shoulder or shoulders is provided on the inner part of the elevator.

7. A dispenser according to claim 1 wherein the barrel is provided at its dispensing end with a removable and contoured cover for acting as a mould for the formation of the material stick.

8. The dispenser according to claim 1 wherein said interface is generally frusto-conical.

9. The dispenser according to claim 1 wherein said first engaging means are a plurality of mutually engaging splines.

10. The dispenser according to claim 1 wherein said interface is generally frusto-conical, and said first engaging means are a plurality of mutually engaging splines.

11. The dispenser according to claim 1 including means for at least temporarily securing said elevator outer part to said barrel at an end thereof opposite said open end.

12. The dispenser according to claim 1 including means for at least temporarily snap-securing said elevator outer part to said barrel at an end thereof opposite said open end by relative axial movement between said barrel and said elevator outer part.

13. A dispenser for semi-solid material in stick form, having a tubular barrel for housing the material and a drive mechanism for moving material axially of the barrel for dispensing at an open end thereof, the drive mechanism comprising an actuator adapted to be rotated by hand and an elevator which is driven axially of the barrel to move material therealong on rotation of the actuator; wherein the elevator comprises a radially outer part adapted to engage and hold the material for moving the same along the barrel in either direction, and a radially inner part separate from the outer part and adapted to be drivingly engaged by the actuator; the inner part of the elevator is received within the outer part of the elevator and engages therewith over an interface extending around the axis of the barrel; first engaging means are provided at the interface for preventing relative rotation of the inner and outer parts of the elevator after assembly, second engaging means are provided for preventing relative axial movement in each direction of the inner and outer parts of the elevator after assembly; and thereby the inner and outer parts of the elevator can be assembled together by relative axial movement without relative rotary orientation; the interface comprising a substantially frusto-conical surface, and the first engaging means comprising a plurality of mutually engaging splines.

14. A dispenser according to claim 3, wherein the barrel includes an inwardly directed flange at the end thereof opposite the said open end, the actuator includes a first latch arranged for engagement with the radial flange whereby to hold the actuator rotatably captive for dispensing, and the outer part of the elevator has a further flange arranged for engagement with the radial flange prior to the engagement thereof by the first latch on insertion of the actuator, whereby to hold the said outer part of the elevator in the barrel for assembly of the elevator parts together.

15. A dispenser for semi-solid material in stick form having a tubular barrel for housing the material and a drive mechanism for moving material axially of the barrel for dispensing at an open end thereof, the drive mechanism comprising an actuator adapted to be rotated by hand and an elevator which is driven axially of the barrel to move material therealong on rotation of the actuator; the elevator comprises a radially outer part adapted to engage and hold the material for moving the same along the barrel in either direction, and a radially inner part separate from the outer part and adapted to be drivingly engaged by the actuator, means for snap-securing said inner and outer parts together by relative axial movement of the said inner and outer parts without relative rotary orientation, and said snap-securing means further holding the inner and outer parts of the elevator against relative movement after assembly thereof; the actuator is adapted to be inserted into the barrel and to be held captive therein for rotation at one end of the tubular barrel by means of an inwardly directed radial flange on the barrel; and the outer part of the elevator is formed with a latch for engagement with the radial flange on the barrel thereby to hold the said outer part in the barrel prior to insertion of the actuator into the barrel.

16. A dispenser for semi-solid material in stick form which comprises a tubular barrel for housing the material and having a filling end and a drive mechanism for moving the material axially of the barrel for dispensing at an open end opposite the said filling end, the drive mechanism comprising an actuator having snap-fit means engageable with the barrel for holding the actuator rotatably captive on the barrel, an elevator for the material, the elevator being disposed within the barrel and comprising a radially outer part adapted to engage and hold the material and a radially inner part drivingly engaged by the actuator for movement along the barrel on rotation of the actuator, said elevator parts having respective engaging means for engagement together by assembly of the actuator and the inner elevator part engaged therewith to the barrel to subsequently hold the elevator parts against relative movement for dispensing, the engaging means of the elevator parts each comprising:

(a) a plurality of splines disposed in frustoconical, circumferentially spaced relation so as to be convergent towards the dispensing end of the barrel; and (b) a latching arrangement;

the pluralities of splines of the two elevator parts being interdigitated so as mutual engagement on a generally frustoconical interface to prevent relative rotation of the elevator parts after assembly, and the latching arrangements being interengaged so as to prevent relative axial movement in each direction of the elevator parts after assembly and thereby to hold the splines in engagement, the arrangement of the elevator parts including the engaging means thereof enabling the elevator parts to be assembled together by relative axial movement, without prior relative angular orientation.

17. A dispenser for semi-solid material in stick form which comprises a tubular barrel for housing the material, and a drive mechanism for moving the material axially of the barrel for dispensing at an open end thereof, the barrel having a filling aperture defined by a radially inwardly directed flange at its end opposite said dispensing end, the drive mechanism comprising an actuator having snap-fit means engageable with the radial flange of the barrel for holding the actuator rotatably captive on the barrel for dispensing, and an elevator for the material, the elevator being disposed within the barrel and comprising a radially outer part adapted to engage and hold the material and a radially inner part drivingly engaged by the actuator for movement along the barrel on rotation of the actuator, the said elevator parts having respective engaging means, for snap-securing said inner and outer parts together by relative axial movement of said inner and outer parts without relative rotary orientation, and the outer elevator part further being formed with a latch which on such assembly is engageable with the radial flange of the barrel to temporarily restrain the outer elevator part against movement along the barrel until such time as the engaging means of the elevator parts have come into engagement.

18. A dispenser for semi-solid material in stick form, which comprises a tubular barrel for housing the material, and a drive mechanism for moving the material axially of the barrel for dispensing at an open end thereof, the barrel having a filling aperture defined by a radially inwardly directed flange at its end opposite said dispensing end, the drive mechanism comprising an actuator having a snap-fit means engageable with the radial flange of the barrel for holding the actuator rotatably captive on the barrel for dispensing, and an elevator for the material, the elevator being disposed within the barrel and comprising a radially outer part adapted to engage and hold the material, and a radially inner part drivingly engaged by the actuator for movement along the barrel on rotation of the actuator, the said elevator parts having respective engaging means which are engageable together by assembly of the actuator and the inner elevator part engaged therewith to the barrel to subsequently hold the elevator parts against relative movement for dispensing, and the outer elevator part further being formed with a latch which on such assembly is engageable with the radial flange of the barrel to temporarily restrain the outer elevator part against movement along the barrel until such time as the engaging means of the elevator parts have come into engagement, the engaging means of the elevator parts each comprising:

(a) a plurality of splines disposed in frustoconical, circumferentially spaced relation so as to be convergent towards the dispensing end of the barrel; and (b) a latching arrangement;

the pluralities of splines of the two elevator parts being interdigitated so as by mutual engagement on a generally frustoconical interface to prevent relative rotation of the elevator parts after assembly, and the latching arrangement being interengaged so as to prevent relative axial movement of the elevator parts after assembly and thereby hold the splines in engagement, the arrangement of the elevator parts including the engaging means thereof enabling the elevator parts to be assembled together by relative axial movement, and without prior relative angular orientation.

* * * * *